United States Patent [19]

Goldstein

[11] Patent Number: 4,563,556

[45] Date of Patent: Jan. 7, 1986

[54] INTERNAL COMBUSTION CIRCUIT BREAKER

[76] Inventor: Michel Goldstein, 59 Patriots Rd., Morris Plains, N.J. 07950

[21] Appl. No.: 594,170

[22] Filed: Mar. 28, 1984

[51] Int. Cl.[4] ..... H01H 35/38

[52] U.S. Cl. ..... 200/82 B; 200/148 R; 200/148 F; 200/151

[58] Field of Search ..... 200/148 F, 148 R, 82 B, 200/151, 148 C, 150 R

[56] References Cited

U.S. PATENT DOCUMENTS 3,384,724 5/1968 Marx et al. ..... 200/148 C 4,250,365 2/1981 McConnell ..... 200/150 R

*Primary Examiner*—Robert S. Macon

*Attorney, Agent, or Firm*—Theodore O. Groeger

[57] ABSTRACT

An internal combustion electrical circuit breaker comprising at least one: (a) insulating cylinder; (b) pair of electrical conductors penetrating the cylinder approximately perpendicular to its longitudinal axis at a distance from both cylinder's plane sides; (c) conducting hollow piston contacting the conductors and an insulating pipe at its open portion, which pipe extends within that axis and penetrates the cylinder's first plane side; (d) arcing chamber extending from that plane side to the conductors; (e) pair of arcing blades within the arcing chamber at a distance from the conductors, piston and pipe; (f) valves within the pipe and first plane side, communicating with the arcing chamber and hollow piston; (g) combustion chamber extending from the piston's closed portion to the cylinder's second plane side; and (h) ignition, gas injection and valve means within the plane side and communicating with the combustion chamber.

When igniting a fuel-oxygen mixture within the combustion chamber, the piston is propelled into the arcing chamber and onto the pipe therein, while the gases within hollow piston and arcing chamber blow across the sparks developing between conductors, piston and arcing blades. This circuit breaker is re-set by injecting compressed gas through the pipe, thereby forcing the piston into the combustion chamber and back onto the conductors, while expelling combustion products and injecting a combustible gas mixture, preferably a stoichiometric (1:2) oxygen/hydrogen mixture into that chamber, which is lined with a material suppressing heat damage and catalytic recombination of the gas mixture therein.

19 Claims, 9 Drawing Figures

FIG. 2
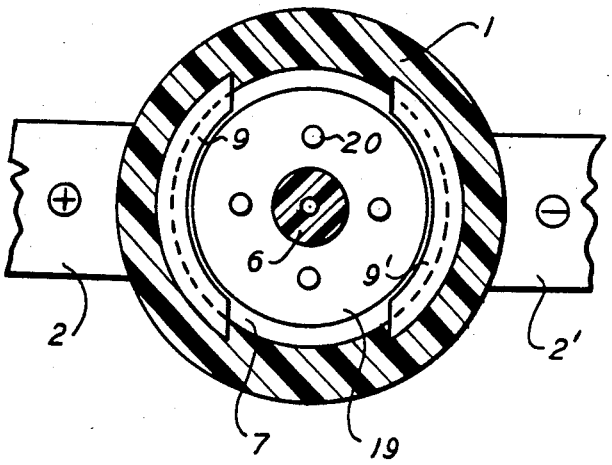
FIG. 3
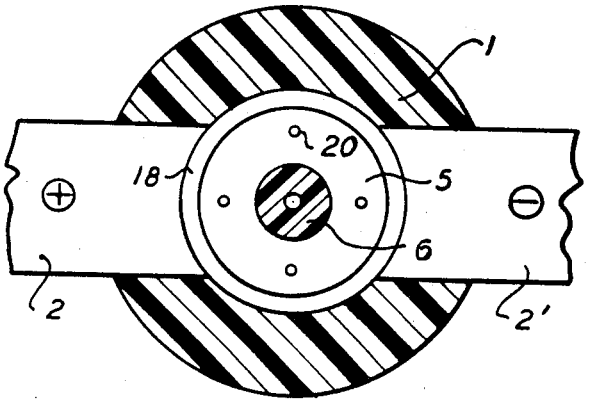
FIG. 4
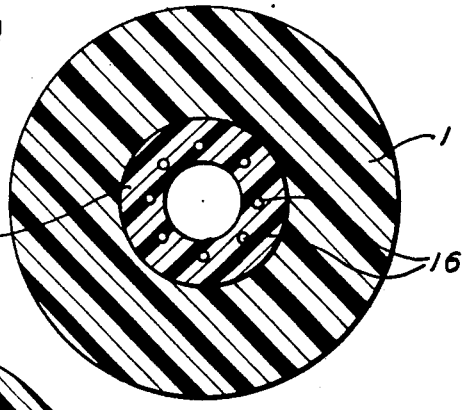
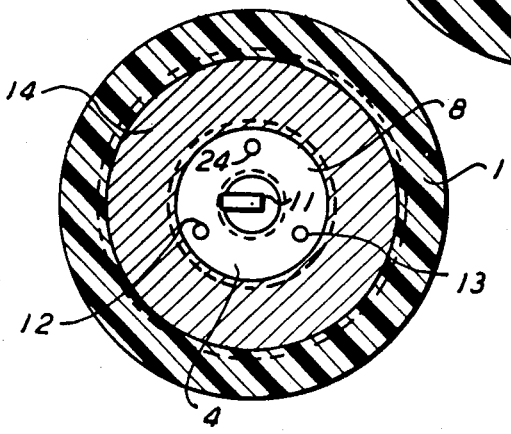
FIG. 5

INTERNAL COMBUSTION CIRCUIT BREAKER

BACKGROUND OF THE INVENTION

An electrical transmission line from a generator to consumers must be protected against insulation failure, or overload, by at least one circuit breaker. It is a mechanical switching device for making, carrying and breaking an electrical contact, comprising a pair of conductor terminals and a bridging member opening and closing the gap therebetween. For high voltage AC-, or high amperage DC-currents, circuit breakers have been designed to operate within narrow time-limits, e.g. within a few cycles, i.e. the period of less than 0.1 second, thereby minimizing damage to generator and consumer-devices alike.

Since it is not possible to interrupt a high voltage, or a large electrical current instantaneously, attention is focussed on: (a) minimizing the mass (inertia) of said bridging member, as is the case in the simple fuse; (b) maximizing the force for moving said member, e.g. by compressed springs or gases, or by electromagnetic forces generated by the fault within the circuit; and (c) extinguishing the sparks (ionized gas and metal vapor) between terminals and bridging member. The latter is achieved with either liquid-filled, or gas-blast circuit breakers, wherein the sparks are removed by vaporization and recirculation of an insulating liquid, such as mineral oil, or diluted with insulating gas, such as air or sulfur hexafluoride ($SF_6$), thereby spreading the sparks over an enlarged area (arc chute).

SUMMARY OF THE INVENTION

The present invention concerns and has for its object the provision of a new internal combustion electrical circuit breaker of the gas-blast type for large and high voltage currents in the region of about 500 to 5,000 A and 600 to 25,000 V AC or DC, preferably about 1,000 A and 1,500 V DC or 3,000 VAC.

A further object of this invention is the improvement of gas-blast circuit breakers by: (a) incorporating light-weight plastic components into said bridging member thereof, thereby reducing inertia; (b) replacing the potential energy of compressed springs or gases, currently utilized for moving said bridging member, by the chemical energy of light-weight explosive gas mixtures, thereby further reducing inertia; (c) improving the geometry of the arc chute and the function of the gas-blast therein; (d) simplifying both component parts, and their manufacture, by extensive utilization of plastic materials; and (e) reducing the dimensions of all parts wherever possible, so that a compact device is obtained, requiring minimal support structures. By the combination of all of these improvements, the time-limits for the operation of the circuit breaker according to this invention are significantly narrowed.

Said circuit breaker comprises at least one:

(a) insulating cylinder;

(b) pair of electrical conductors, spaced apart and penetrating said cylinder approximately perpendicular to its longitudinal axis at a distance from said cylinder's plane sides;

(c) hollow piston supported by said cylinder at its closed portion and an insulating pipe at its open portion for movement between a conductor-contacting and -disconnected position, which piston's conducting open and closed portions are separated by an insulating middle portion, and, which pipe extends within said axis and is attached to said cylinder's first plane side;

(d) arcing chamber extending from said conductors to said first plane side and communicating with said conductor-disconnected hollow piston via at least one duct therein;

(e) pair of arcing blades within said arcing chamber at a distance from each other said conductors, piston and pipe;

(f) valve means within said pipe and first plane side, communicating with said arcing chamber and hollow piston;

(g) combustion chamber extending from said piston's closed portion to said cylinder's second plane side; and (h) ignition, gas injection and valve means within said second plane side and communicating with said combustion chamber.

This invention also concerns any new part and combination of parts disclosed herein, the process for their manufacture, as well as their use.

BRIEF DESCRIPTION OF THE DRAWINGS

FIG. 2 is a cross-sectional view of the FIG. 1 circuit breaker at plane A, which is perpendicular to said axis.

FIGS. 3 to 5 are cross-sectional views of the FIG. 1 circuit breaker at planes B, C, and D respectively.

Figure 1:
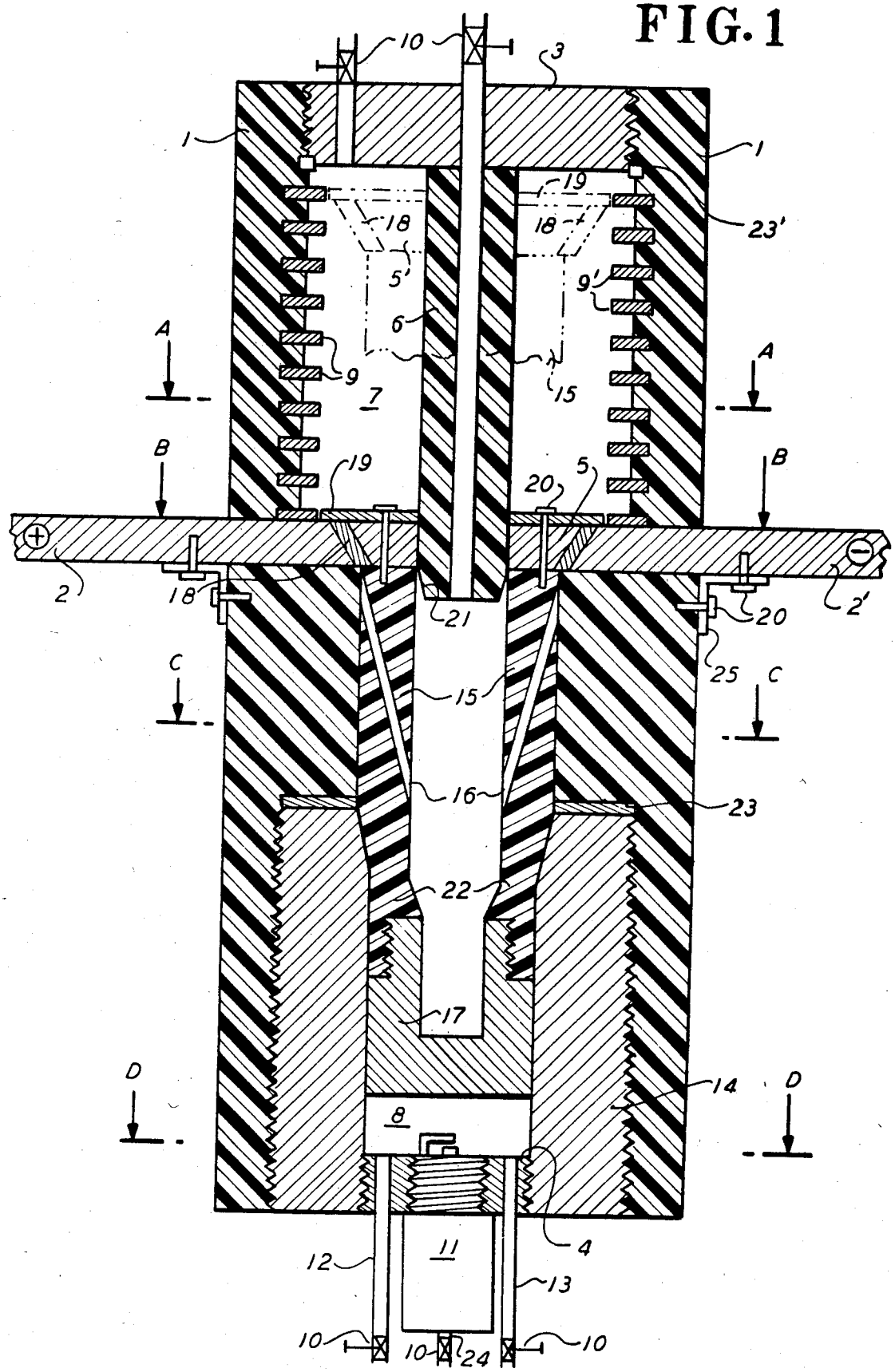
FIG. 1 is a cross-sectional view of the circuit breaker at its longitudinal axis, with the piston in both extreme positions.

Said simplified drawings illustrate schematically the most exemplary embodyments of this invention, and the numerals 1 to 35 therein refer to similar parts throughout this specification. They are collectively defined as follows: 1=insulating cylinder, 2=electrical conductors; 3=cylinder's first plane side, 4=cylinder's second plane side, 5=hollow piston's open portion, 6=insulating pipe, 7=arcing chamber, 8=combustion chamber, 9=arcing blades, 10=valve means, 11=ignition means, 12=fuel injection means, 13=oxygen injection means, 14=combustion chamber's lining, 15=insulating portion of hollow piston, 16=gas ducts within hollow piston, 17=closed portion of hollow piston, 18=conducting portion of hollow piston, 19=arcing contact portion of hollow piston, 20=screws, 21=tapered portion of insulating pipe, 22=tapered portion of hollow piston, 23=seals, 24=exhaust valve means, 25=fastening means, 26=annular contacts of electromagnet within hollow piston, 27=electromagnet's coil, 28=lubricating tube, 29=ferromagnetic portion of hollow piston, 30=electromagnet's connector, 31=gas-sensor's connector, 32=bouncer-seal for hollow piston, 33=insulating arrestor for arcing blades, 34=spring, 35=electrical wiring.

DESCRIPTION OF THE PREFERRED EMBODIMENTS

The mode of operating with the circuit breaker according to FIGS. 1-5 is as follows: Both arcing chamber 7 and hollow piston 5, within the insulating cylinder 1, are filled with insulating gas, such as hydrogen, helium, air or $SF_6$, via pipe 6 and valves 10 within the cylinder's first plane side 3, at superatmospheric pressure, thereby pressing the piston's conducting conical portion 18 onto a similar portion of both the conductors (terminals) 2 and 2'. Thereupon the combustion chamber 8 is flushed with oxygen or air via the injection and exhaust means 13 and 24 respectively, followed by the injection of the proper amount of fuel, such as hydrogen, hydrocarbons or natural gas, via injector 12, with the proviso that the gas pressure within chamber 8 is smaller than in 7. This is achieved by the proper manual or automatic setting of all pressure reduction valves 10 between gas bottles and said chambers. The sequence of said filling operation is advantageously carried out by a programmable microprocessor's electrical impulses to the gas injection and valve means similar to those utilized in internal combustion engines of motor vehicles.

At whatever preprogrammed circuit conditions, said microprocessor will deliver a high voltage to the ignition means 11, thereby causing the oxygen/fuel mixture within chamber 8 to explode, and the combustion gases propel the hollow piston 5 into the arcing chamber 7 and onto the pipe 6, until the tapered portions, 22 and 21 respectively, thereof contact each other. FIG. 1 shows said portions starkly exaggerated, however, a taper of about 3° to 8° will sufficiently lock the piston 5 in the position indicated by broken lines therein, by the friction of its insulating portion 15 at pipe 6. During the movement of said piston the insulating gas therein is compressed and expelled, via the ducts 16 therein, into the first, circular spark zone between the high melting portions of piston 5 and pair of conductors 2 and 2', and finally into the arc chute composed of the arcing blades 9 and the cylindrical portion 19 of said piston, all of which portions are fastened onto the insulating main piston part 15 via the screws 20 therein. With the piston's entering the arcing chamber 7, the gas pressure therein will also rise to a predetermined level set in the reduction valve 10, whereupon it will vent into the atmosphere via said valve means within the cylinder's plane side 3. For re-setting said piston, or making its contact with the conductors respectively, the valve 10 within pipe 6 is opened, as mentioned in the outset, and the gas bottles's pressure applied to the piston's closed portion 17, thereby unlocking it from the tapered portion 21 of said pipe, and during the piston's movement insulating gas is recirculated into the arcing chamber via ducts 16 and/or valve 10 within the cylinder's first plane side 3, while the exhaust valve means 24 is opened. The latter also acts as a one-way valve admitting atmospheric air for preventing reduced pressure within the combustion chamber 8, e.g. by condensation of water on the metallic surfaces of the piston's closed portion 17, the chamber's lining 14, and the cylinder's second plane side 4. The insulating cylinder 1 may be solely supported by the conductors 2 and 2' via the fastening means 25 and the screws 20 therein, or by an additional, e.g. three-legged support structure not shown. Both arcing and combustion chambers communicate with the atmosphere via said valves 10 within the cylinder's plane sides 3 and 4, and the gas injectors 12, 13 and pipe 6 are hose-connected to the fuel-, oxygen- and insulating gas-bottles of conventional size and pressure limits, which are also not shown; nor is the conventional wiring of automatic valve 10 and ignition 11 means shown in FIGS. 1 to 5, in order to focus attention to the essential and novel embodiments of the present invention.

Figure 6:
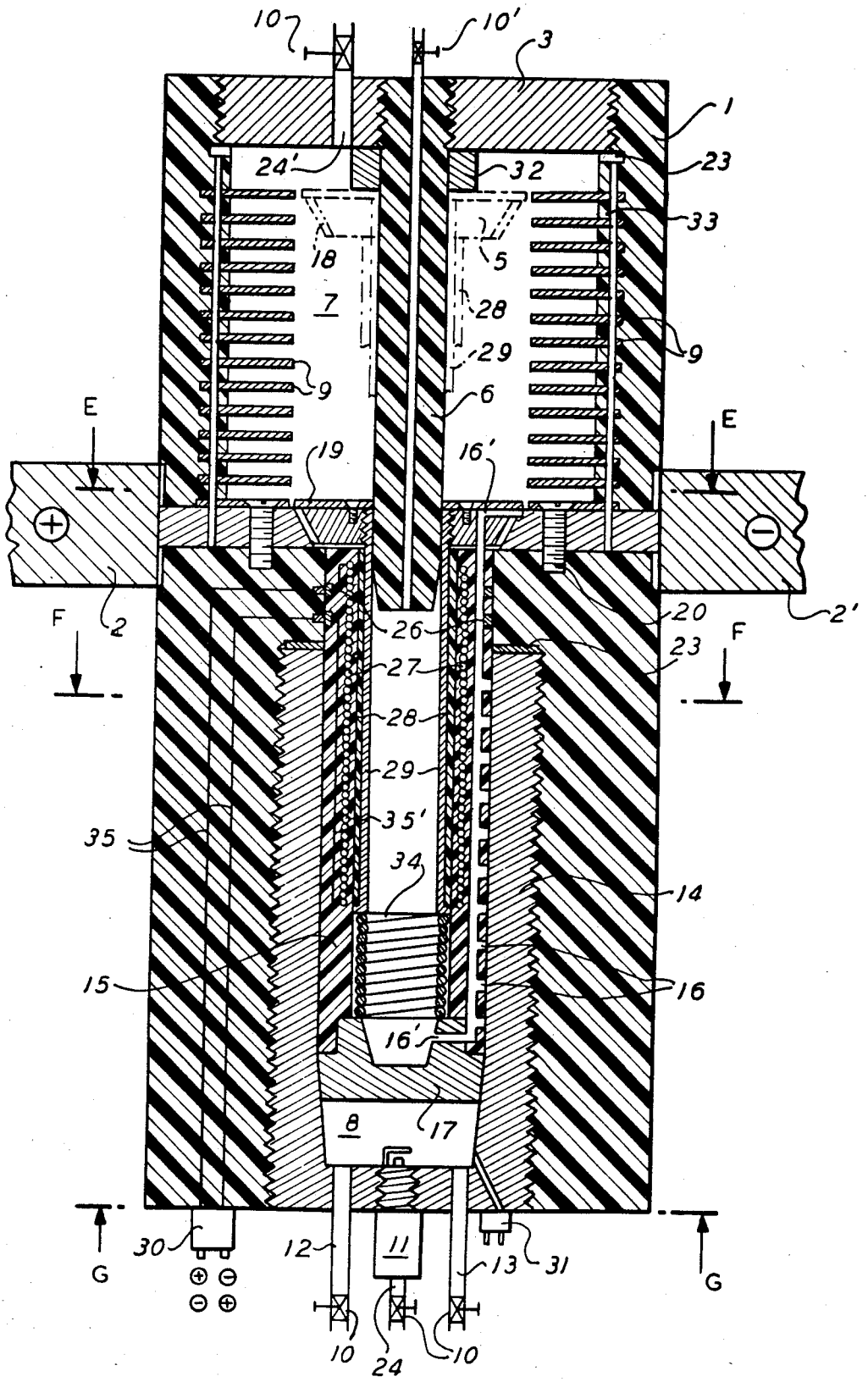
FIG. 6 is a cross-sectional view of a circuit breaker, supplemented by an integral (spring/magnetic) contactor, at its longitudinal axis, with the contactor-piston in both extreme positions, and the breaker-piston in the operating position.
Figure 7:
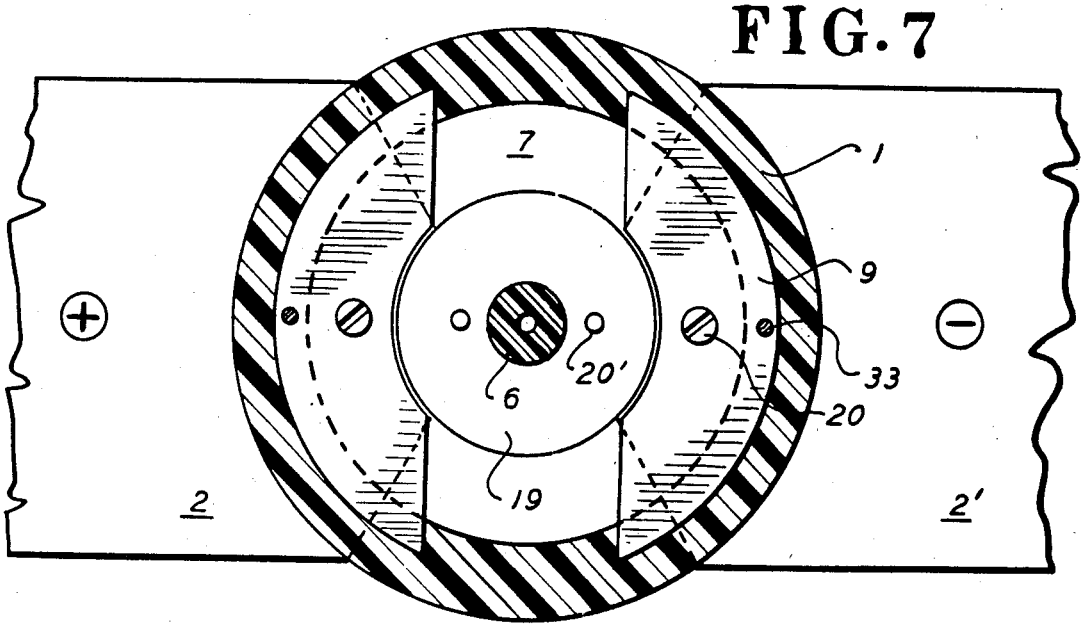
FIGS. 7 to 9 are cross-sectional views of the FIG. 6 circuit breaker/contactor at planes E, F, and G respectively.
Figure 8:
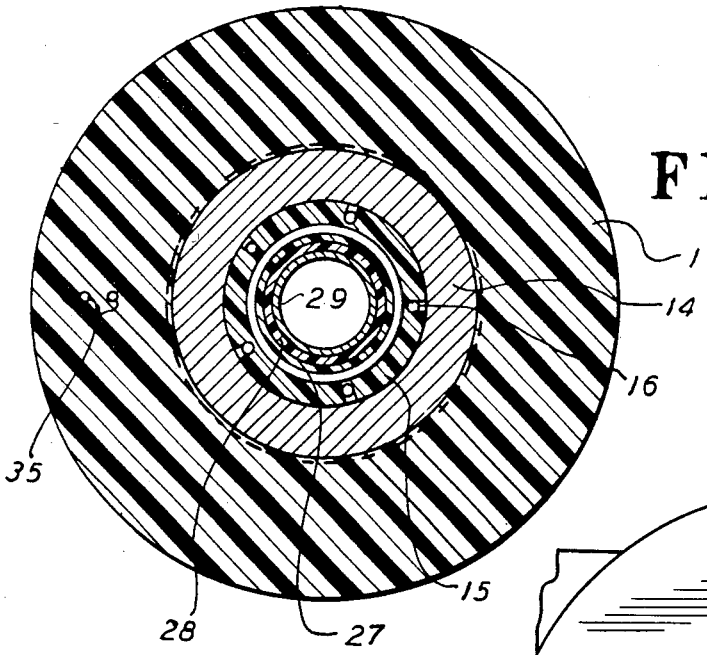
Figure 9:
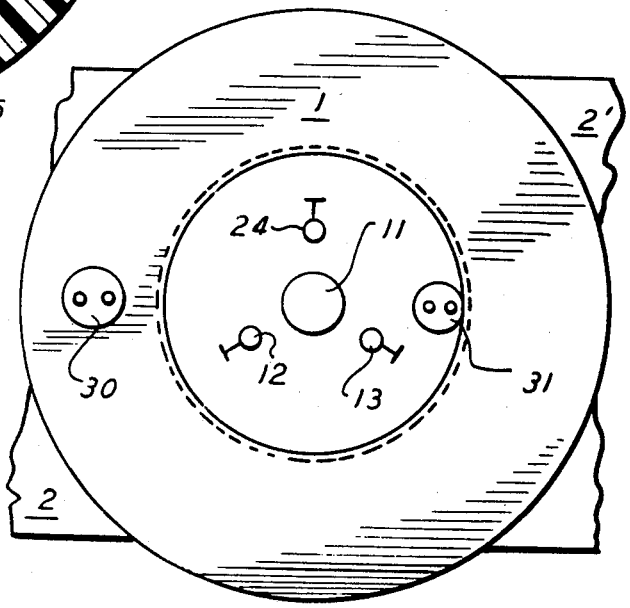

The circuit breaker/contactor, depicted by FIGS. 6 to 9, combines the functions of three separate, conventional devices, i.e. it offers: (a) said overload protection (often achieved with onetime, disposable devices), (b) a regular load switching operation, and (c) an automatic, spring-activated sectionalizing (opening) of the circuit, should any of the former functions fail. In variation to the former circuit breaker, wherein the conducting and insulating portions of the hollow piston 5 are connected via screws 20, FIG. 6 shows said conducting, open portion of the hollow piston 5 (covered by the conducting portions 18 and 19) connected with a ferromagnetic tube 29, resting on the compressed spring 34, by the action of the energized electromagnet within the insulating portion 15 of the hollow piston, comprising the coil 27, the wiring 35', and the terminal annular contacts 26, which, in turn, are wired via 35 to the magnet's connector 30, supplying it with a DC-current sufficient for pressing said piston 5 onto the conductors 2 and 2', and attracting said magnetic tube 29 against the potential energy of spring 34. By the mere switching off, or transpolarizing said electromagnet, the compressed spring 34 will expand, thereby disconnecting said piston 5 from the conductors 2 and 2' via tube 29, whose frictional losses are minimized by the covering lubricating, e.g. Teflon tube 28. Under these regular switching conditions, no insulating gas blast is necessary for quenching the sparks resulting from normal interruption; the movement of the arcing contact 19 across a few pairs of arcing blades 9 will be sufficient. However, depending on the length of the uncompressed spring 34, the circuit's load, and the reverse-current's voltage delivered to coil 27, the hollow piston 5 may be propelled through the whole arcing chamber 7 until it reaches the bouncer-seal 32, which may be a permanent magnet as well, for arresting said piston in the position shown in FIG. 6 by broken lines.

The electronic (computerized) control circuit will not restore current to the electromagnet's connector 30, until the combustion chamber's gas-sensor connector 31 feeds the signal for the chamber's proper filling with said fuel-oxygen mixture (or the corresponding valving sequence respectively) back to control. In case this contactor is re-set when a fault (short circuit) has occurred, said control circuit will deliver a high voltage to the ignition means (spark plug) 11, and the whole electromagnet/hollow piston combination will be propelled through the arcing chamber 7, as described in the outset, and the gas blast via the ducts 16 and 16' (if desired augmented by injection of additional insulating gas through pipe 6 and valve 10 therein) within the insulating portion 15 of the (electromagnetic) hollow piston 5.

For the sake of safety, said portion 15 is re-set by a gas blast through pipe 6, whereby the electromagnet within is reconnected, via its annular contacts 26, to the wiring 35 and the connector 30. Thereupon, the conducting piston 5/ ferromagnetic 29/lubricating 28 tube-combination is retracted by energizing coil 27, if necessary while applying a positive pressure through pipe 6, or a negative pressure through the exhaust valve means 24. Should the control circuit fail, the spring 34 will automatically disengage said piston/tube-combination from the conductors 2 and 2'.

DESCRIPTION OF EQUIVALENT EMBODIMENTS

Having described and schematically depicted the most exemplary embodiment of this invention, the following lists some of the obvious equivalents or derivations thereof. Thus, for example, the disconnected open portion 5 of the hollow piston may not only be held in the extreme (upper) position by the friction of the lokking tapers 21 and 22, but also (or instead) by permanent pelletmagnets embedded in either the cylinder's plane side 3, thereby attracting the piston's ferromagnetic, cylindrical portion 19 and/or screws 20; or within the thickened middle-portion of cylinder 1 and opposite sites of the piston's insulating portion 15, so that opposite poles of said embedded magnets attract each other in the piston's position shown in FIG. 1 by broken lines, thereby ensuring the safe operation of this circuit breaker.

Variously, the sparking chamber 7 may be greatly extended to accomodate additional pairs of conductors 2 and 2', advantageously three for multiphasic AC, with a concomitant extension of the pipe 6 and the piston's insulating portion 15 beyond its arcing portion 19, e.g. as indicated by the broken lines in FIG. 1, at which location another pair of conductors 2 and 2' would penetrate cylinder 1, and the arcing chamber 7 would be twice as long as indicated. All of the piston's open portions 5 would come to rest approximately midway between all terminals 2 and 2', i.e. never reconnecting any thereof, unless this is designed for the simultaneous reclosing of another circuit. In the latter case, the conical conductor and piston portions 18 would be reversed, i.e. turned around 180° relative to the first (lower) portion 18.

Naturally, the proportions of the combustion chamber 8 may also be increased, e.g. by utilizing a thinner chamber lining 14 and a wider closed piston portion 17, which latter may also carry a seal 23, in order to confine the propellants for long time periods therein.

If not mentioned already, the circuit breakers according to this invention are constructed of any suitable and preferably cheap material, as is utilized already for purpose-similar parts, and by conventional engineering techniques. Thus, for example, the cylinder 1, its plane side 3, the pipe 6 and piston portion 15, may consist of glass or organic fiber reinforced acetal or epoxy resins (Delrin or Araldite); the conductors 2 and piston portions 5 of aluminum or copper; its closed portion 17, the combustion chamber's lining 14 and the cylinder's second plane side 4 of duralumin or advantageously stainless steel, as is the case of the ignition means' electrodes, in order to suppress any catalytically activated recombination of the propellant mixture contained therein; the conducting high melting piston portions 18 and 19, and the arcing blades 9 of silver/cadmium or copper/-chromium or tungsten alloys and the like. The remaining parts are conventional, manual or advantageously automatic valves 10 (as utilized in the chemical and oil industries), fuel injectors and ignition means 12, 13 and 11 respectively (as utilized in automobiles), as well as standard fastening means 25 and screws 20, pressure hoses connecting said valves and injectors to conventional (bottled) gas sources, and their suppporting means. Moreover, gas-sensing, pressure-sensing and monitoring devices, together with the corresponding hard and soft ware, are advantageously utilized for the proper use of said insulating and propelling gases, i.e. similar to those utilized in said industries, or power plants respectively. Also the seals 23 correspond to the gases contacting them, e.g. silicone rubber for sealing the combustion chamber 8, and chlorinated or fluorinated polyethylenes for the arcing chamber 7 and/or valve 10 connections.

I claim:

1. An internal combustion electrical circuit breaker comprising at least one: (a) insulating cylinder; (b) pair of electrical conductors, spaced apart and penetrating said cylinder approximately perpendicular to its longitudinal axis at a distance from said cylinder's plane sides; (c) hollow piston supported by said cylinder at its closed portion and an insulating pipe at its open portion, for movement between a conductor-contacting and -disconnected position, which piston's conducting open and closed portions are separated by an insulating middle portion, and which pipe extends within said axis and is attached to said cylinder's first plane side; (d) arcing chamber extending from said conductors to said first plane side and communicating with said conductor-disconnected hollow piston via at least one duct therein; (e) pair of arcing blades within said arcing chamber at a distance from each other, said conductors, piston and pipe; (f) valve means within said pipe and first plane side, communicating with said arcing chamber and hollow piston; (g) combustion chamber extending from said piston's closed portion to said cylinder's second plane side; and (h) ignition, gas injection and valve means within said second plane side and communicating with said combustion chamber.

2. A circuit breaker according to claim 1, wherein said arcing chamber is filled with an insulating gas at superatmospheric pressure.

3. A circuit breaker according to claim 2, wherein said gas is selected from hydrogen, helium, air or sulfur hexafluoride.

4. A circuit breaker according to claim 1, wherein said combustion chamber is filled with a combustible gas mixture at a pressure smaller than that in said arcing chamber.

5. A circuit breaker according to claim 4, wherein said mixture is selected from stoichiometric amounts of oxygen, air, hydrogen, hydrocarbons and natural gas.

6. A circuit breaker according to claim 5, wherein said mixture is a 1:2 oxygen and hydrogen mixture.

7. A circuit breaker according to claim 1, wherein said piston's insulating portion is tapered, fitting on a similarly tapered terminal portion of said pipe.

8. A circuit breaker according to claim 7, wherein said taper is about 3° to 8° relative to said pipe's longitudinal axis.

9. A circuit breaker according to claim 1, wherein said hollow piston contains a plurality of ducts extending from its pipe-contacting surface to the vicinity of its conductor-contacting surface.

10. A circuit breaker according to claim 1, wherein said hollow piston and conductor contacting portions, and said arcing blades, are lined with a high melting material.

11. A circuit breaker according to claim 10, wherein said material is an alloy selected from silver/cadmium, copper/chromium and copper/tungsten.

12. A circuit breaker according to claim 1, wherein said cylinder and/or hollow piston contain magnets.

13. A circuit breaker according to claim 12, wherein said piston's conducting portion is connected to a ferromagnetic tube fitting into the piston's insulatin portion, which latter contains an electromagnetic coil capable of attracting said tube.

14. A circuit breaker according to claim 13, wherein said piston contains a spring contacting the piston's closed portion and said magnetic tube, which spring is capable of being compressed by said coil's magnetic attraction of said tube.

15. A circuit breaker according to claim 12, wherein said cylinder and piston contain permanent magnets capable of locking the piston in a position disconnected from the conductors.

16. A circuit breaker according to claim 1, wherein said arcing chamber contains a plurality of arcing blade and conductor pairs.

17. A circuit breaker according to claim 16, wherein said arcing chamber contains a plurality of arcing blade pairs and three conductor pairs contacting three conducting portions of the hollow piston therein.

18. A circuit breaker according to claim 1, wherein said combustion chamber is lined with a material suppressing heat damage and catalytic recombination of the combustible gas mixture therein.

19. A circuit breaker according to claim 18, wherein said material is selected from duralumin and stainless steel.

* * * * *